US008181279B2

(12) United States Patent
Byrd et al.

(10) Patent No.: US 8,181,279 B2
(45) Date of Patent: May 22, 2012

(54) MULTI-LAYERED MULTI-PURPOSE BELT PACK

(76) Inventors: Linda Byrd, Chireno, TX (US); James Byrd, Chireno, TX (US); Miriam Cheever, Nacogdoches, TX (US)

( * ) Notice: Subject to any disclaimer, the term of this patent is extended or adjusted under 35 U.S.C. 154(b) by 859 days.

(21) Appl. No.: 12/102,835

(22) Filed: Apr. 14, 2008

(65) Prior Publication Data

US 2008/0257930 A1 Oct. 23, 2008

Related U.S. Application Data

(63) Continuation-in-part of application No. 11/338,600, filed on Jan. 24, 2006, now Pat. No. 7,356,853.

(60) Provisional application No. 60/647,258, filed on Jan. 26, 2005.

(51) Int. Cl.
*A41D 13/00* (2006.01)

(52) U.S. Cl. ..... 2/310

(58) Field of Classification Search ..... 2/236, 220, 2/235, 219, 300, 310–328, 920, 93, 94, 245, 2/253; 224/153, 192, 625, 657
See application file for complete search history.

(56) References Cited

U.S. PATENT DOCUMENTS

| | | | | |
|---|---|---|---|---|
| 4,525,879 | A * | 7/1985 | Kalomeris | 2/338 |
| 5,060,835 | A * | 10/1991 | Payne | 224/148.2 |
| 5,294,031 | A * | 3/1994 | Volpei et al. | 224/682 |
| 5,374,919 | A * | 12/1994 | Zelka et al. | 340/574 |
| 5,492,496 | A | 2/1996 | Walker | |
| 5,785,671 | A | 7/1998 | Striano | |
| 5,862,526 | A * | 1/1999 | Longcor et al. | 2/338 |
| 6,189,154 | B1 * | 2/2001 | Ducharme | 2/338 |
| 6,766,532 | B1 | 7/2004 | Cabana | |
| 7,356,853 | B2 | 4/2008 | Byrd et al. | |
| 7,637,218 | B1 * | 12/2009 | Burton | 108/43 |

* cited by examiner

*Primary Examiner* — Tejash Patel
(74) *Attorney, Agent, or Firm* — Kammer Browning PLLC

(57) ABSTRACT

A multi-layered, multi-purpose belt pack, wherein each layer performs particular storage functions and acts in complementary fashion to provide a particularly effective belt pack. The multi-layered main member is secured about the waist of the user by a belt member to provide multi-functional storage utility. This unitary belt pack provides compact, organized, and efficient personal storage of essential items in an easily accessible manner.

18 Claims, 5 Drawing Sheets

MULTI-LAYERED MULTI-PURPOSE BELT PACK

CROSS REFERENCE TO CORRESPONDING APPLICATION

This application is a Continuation-in-Part of U.S. patent application Ser. No. 11/338,600, filed Jan. 24, 2006 now U.S. Pat. No. 7,356,853, which claims the benefit under Title 35 United States Code §119(e) of U.S. Provisional Application No. 60/647,258 filed Jan. 26, 2005.

BACKGROUND OF THE INVENTION

1. Field of the Invention

The present invention generally relates to sports activity protection belts and multi-purpose belt packs. More specifically, the present invention relates to a sports activity protection belt having a padded member of multi-layer configuration and to a multi-layered multi-purpose belt pack, where each layer performs particular functions and acts in complementary fashion to provide a particularly effective belt or belt pack. The multi-layered member is secured about the waist of its user by a belt member to provide either abdominal protection or multi-functional storage utility.

2. Description of the Related Art

The use of various padding and other protective equipment for use during sports activity is known. More specifically, sports activity protection apparatus heretofore devised and utilized are known to consist basically of familiar, expected and obvious structural configurations, notwithstanding the myriad of designs encompassed by the prior art which have been developed for the fulfillment of different objectives and requirements. While these devices may fulfill their respective, particularly claimed objectives and requirements, the aforementioned devices do not disclose a sports activity protection apparatus and method of use such as Applicant's present invention.

Known sports activity protection apparatuses are hampered by limitations overcome by Applicant invention. More specifically, devices known in the art do not provide a protection mechanism that is both light weight and particularly effective in absorbing and distributing shock. In fact, those skilled in the art largely agree that a glaring limitation associated with such products is remaining light enough to avoid hindering sports performance while offering adequate protection. While there are known products that may secure about the waist or torso of a sports player, such products sacrifice mobility for the benefit of more protection, and vice versa. After all, until now, protection devices have not been able to offer adequate shock absorption while remaining light enough to be worn while running at full speed.

Those playing sports games, such as soccer, where there is a likelihood of having contact with sports balls or other players would be well served to be equipped with a device such as the present invention. That is, those playing such games would greatly benefit from a device that could be worn during games or practice, with no detrimental effect to performance, while offering superior protection. As will be fully discussed, Applicant's invention, through a novel arrangement of component parts, provides such an apparatus.

Similarly, the use of utility belts is also well known in the art. Such prior art belts are generally designed to serve a single need, such as to hold tools or money. Whereas these belts fulfill such limited functionality, they are not designed to provide a multi-purpose belt such as that described by the present invention. The utility belts in the prior art have limitations as to their functionality and accessibility. These belts tend to be cumbersome and heavy, limiting both the usefulness and length of wearing time for the user. Until now, utility belts have not been able to meet the wide variety of needs of the modern user.

For those traveling, commuting, hiking, shopping, or engaging in any other activity where it would be beneficial to have a multi-purpose belt pack which enables hands-free storage for numerous items and yet also permits ready access to these items, Applicant's invention provides a convenient and versatile solution.

SUMMARY OF THE INVENTION

The general purpose of the first preferred embodiment of the present invention, which will be described subsequently in greater detail, is to provide a new sports activity protection apparatus and method of use which has many of the advantages of such apparatus known in the art and many novel features that result in a new apparatus and method of use which is not anticipated, rendered obvious, suggested, or even implied by any of the known apparatus or methods, either alone or in any combination thereof.

In satisfaction of the above, the first preferred embodiment of the present invention provides a sports activity protection apparatus and method of use that is new and unobvious in view of known products. This apparatus, by way of a novel multi-layer configuration, provides for a particularly effective sports protection apparatus and method of use with respect to performance, durability, flexibility, and size-to-weight ratio. In fact, results achieved by the present invention are simply not possible with any other known treatments.

In its most preferred form, the padded member of the first preferred embodiment of the present apparatus is generally of an elongate shape, having a broader center section while being tapered about each distal end. Such a configuration is particularly beneficial in that it allows its user a free range of motion while protecting the most vulnerable parts of the body. More specifically, this configuration allows a sports player to bend, twist, or rotate at the waist without restriction while offering protection of the solar plexus and groin area. Particular embodiments are envisioned where the padded member is of different dimensions, sized according to whether it is to be used by a child or an adult. As such, the general arrangement of component layers of the padded member remains the same, while its actual dimension may vary to better suit the size of the player wearing the padded member.

The apparatus of the present invention provides for a padded member secured about the waist of its user by a belt member. The belt member extends from each distal end of the padded member to wrap around the waist of a sports player. The belt member may be securely fastened by any number of arrangements as known in the art. For example, the belt may contain plastic clips that fit into one another. Particular embodiments are envisioned where the belt member is elastic and may be put on by either "stepping into" the apparatus, or pulling it down from over the head. Such an embodiment is particularly useful for quickly changing into, and out of, the apparatus during the course of a game or practice. Finally, in its most preferred form, the belt member is actually comprised of two individual belts that wrap around the waist of the player. Two smaller belts are preferred over a single larger belt as such an arrangement maintains a more secure fit as the player's body moves during use.

The padded member is characterized by a multi-layer configuration, where each layer performs a specific function.

Each layer, alone and in combination with other layers, imparts several novel attributes to Applicant's invention. The, first, or outermost layer is comprised of some material such as nylon or some composite thereof. This layer provides strength for holding the apparatus together and flexibility in allowing the apparatus to contour to the shape of its user. Further, the outer layer is particularly beneficial in that it is somewhat breathable and does not induce agitation or itching for its user as the apparatus is worn.

The second outermost layer is juxtaposed with the inside of the first layer and the outside of a third layer. This second layer functions primarily as a protection for the inner layers, adding durability and water resistance to the device.

A relatively thin third layer is juxtaposed with the inside of the second layer and the outside of a fourth layer. Of course, the third layer does provide some degree of protection by simply acting as an additional layer of padding; however, the third layer largely serves to eliminate relative movement between the second and fourth layers. That is, the third layer is comprised of some course material that essentially "grabs" the second and fourth layers. Without this layer, the apparatus would be of diminishing usefulness over time as the protective materials contained within became distorted under the outside material. In fact, a common problem associated with known protective members is "bunching" of protective material as the player moves during the course of its use. In novel fashion, Applicant's invention eliminates any such problem.

The fourth layer is juxtaposed with the inside of the third layer and the outside of a fifth layer. In its most preferred form, this layer is comprised of a foam material and is approximately between one eighth and one quarter inch in thickness. This foam layer provides for shock absorption and distribution, and, provides structural integrity to the apparatus overall.

The fifth layer is juxtaposed with the inside of the fourth layer and the outside of the sixth (or inner most) layer. The fifth layer is thick batting layer; however, it is somewhat similar to the second layer in so much as it is comprised of a course material that "grabs" surrounding layers to hold each intact with respect to the other. This layer is particularly effective in protecting the inner most layer, which contains air-filled bladders, from abrasive forces that may cause damage. Finally, while this layer may be relatively thick (preferably being between one quarter to one half inch thickness), its porous nature contributes to the apparatus being relatively light weight.

The sixth or innermost layer is positioned within the central-most portion of the apparatus. Preferably, this layer is made up of a dual layered system of some plastic component having a series of air-filled bladders. This layer serves as the core of the apparatus and is excellent in responding to forces exerted thereon. More specifically, the air filled bladders efficiently react to the force imparted by objects contacting the padded member and respond to bending or folding of the padded member caused by the player's movement during use. Finally, this innermost layer may have air bladders of different dimensions to better accommodate the expected strength of incident forces (i.e., adults may need greater protection in most instances) and comprise one or more layers to further provide protection.

While the apparatus of the first preferred embodiment of the present invention may seem trivial at first glance, its unique construction proves otherwise. That is, the combination of layers having foam padding and air-filled bladders provides for excellent shock absorption. Also, these layers are malleable enough to withstand bending and folding of the apparatus caused by the users' movement during use. Additional layers are sandwiched throughout the apparatus to ensure the constituent layers do not slip or slide with respect to each other. These layers are relatively porous and therefore do not impart undue mass to the apparatus. Moreover, these layers provide their own level of shock absorption and further serve to protect other constituent layers.

The second preferred embodiment of the present invention provides a novel, multi-layered, multi-purpose belt pack having a design which facilitates use of the belt for a combination of functions. This embodiment of the present invention provides a unified holder for multiple functions and does so in an organized, efficient, and easily accessible manner. These benefits are simply not found with other belt packs in the prior art. The main member of this embodiment of the present invention is also generally of an elongate shape, having a broader center section while being tapered about each distal end. As noted previously, such a configuration is particularly beneficial in that it allows the user a free range of motion for bending, twisting, or rotating at the waist without restriction. The main member may be of different dimensions, sized according to the height and weight of the user. As such, the general arrangement of the component layers of the main member remains the same, while its actual dimensions may vary to better fit the size of the user.

The second preferred embodiment of the present invention provides for a multi-layered main member secured about the waist of its user by a belt member. The belt member extends from each distal end of the padded member to wrap around the waist of the user. The belt member may be securely fastened by any number of arrangements as known in the art. For example, the belt may contain plastic clips that fit into one another. Particular embodiments are envisioned where the belt member is elastic and may be put on by either "stepping into" the apparatus, or pulling it down from over the head. The belt member may be comprised of two individual belts that wrap around the waist of the user, thus maintaining a more secure fit.

The main member is characterized by a multi-layer configuration, where each layer performs a specific function, both on the side facing away from the user and the side facing the body of the user. Each aspect of each layer imparts several novel attributes to Applicant's invention.

The first layer of the second preferred embodiment of the present invention contains an array of multi-compartment pockets, a bottle pocket or pouch, and expandable sides with zippers. The inner aspect of the first layer has a holster pocket, flashlight pocket, and another miscellaneous pocket. The second layer contains an array of elastic straps for holding a variety of articles in position and a mesh pocket with a zippered opening. The inner aspect of the second layer has a section for paper currency and a coin pocket with coin holders for coin currency. The third layer has a pocket for a camera and an array of pockets for credit cards and the like. The inner aspect of the third layer contains an I.D. card holder.

The unique construction of this belt pack provides an enhanced functionality not found in the prior art. The overall shape of the main member permits comfort of movement for the user while the multiple layers having a wide variety of pockets, zippers, and straps provides versatility and convenience.

BRIEF DESCRIPTION OF THE DRAWINGS

Applicant's invention may be further understood from a description of the accompanying drawings, wherein unless otherwise specified, like referenced numerals are intended to depict like components in the various views.

DETAILED DESCRIPTION OF THE PREFERRED EMBODIMENTS

Figure 1:
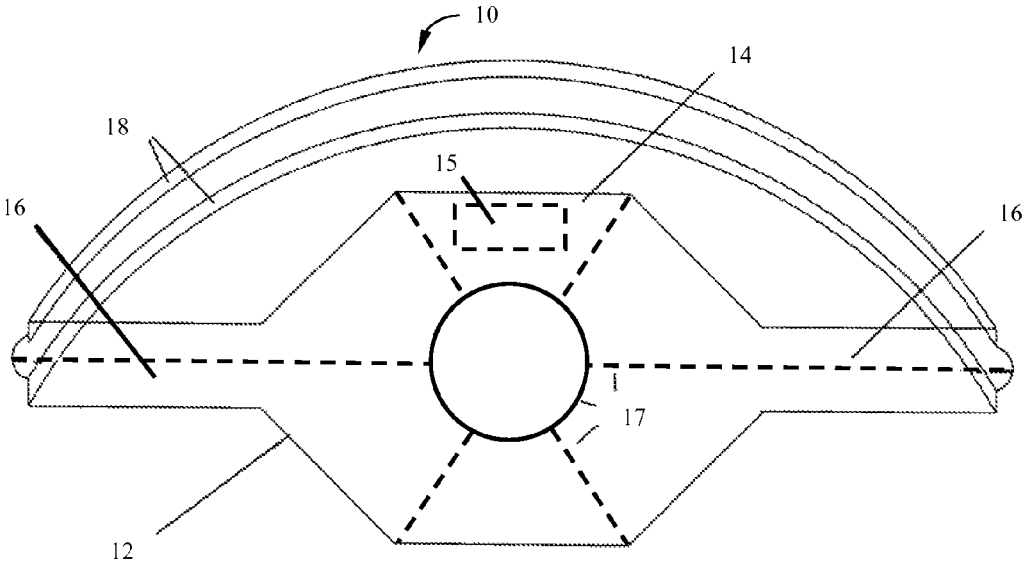
FIG. 1 is a perspective view of the apparatus of the first preferred embodiment of the present invention.

Referring to FIG. 1, the apparatus of the present invention is generally designated by the reference numeral 10. Apparatus 10 is primarily characterized by a padded member 12 in combination with a belt member 18.

Padded member 12, in the preferred embodiment, is generally of an elongate shape, having a broader center section 14 while being tapered about each distal end 16. As seen in FIG. 1, padded member 12 is held together via stitching members 17. Such a configuration is particularly beneficial in that it allows its user a free range of motion while protecting the most vulnerable parts of the body. More specifically, this configuration allows a sports player to bend, twist, or rotate at the waist without restriction while offering protection of the solar plexus and groin area. Particular embodiments are envisioned where padded member 12 is of different dimensions, sized according to whether it is to be used by a child or an adult. As such, the general arrangement of component layers of padded member 12 remains the same, while its actual dimensions may vary to better suit the size of the player wearing apparatus 10. Finally, padded member 12 may include a hidden zipper pocket 15 located on the back upper portion of padded member 12.

Apparatus 10 is further characterized by belt member 18, which serves to secure padded member 12 about its user. Belt member 18 extends from each distal end 16 of padded member 12 to wrap around the waist of a sports player. Belt member 18 may be securely fastened by any number of securing means as known in the art. For example, the connecting portions of belt 18 may contain plastic clips that fit into one another. Particular embodiments are envisioned where belt member 18 is comprised of elastic or a similar material so that apparatus 10 may be put on by either "stepping into" the apparatus, or pulling it down from over the head. Such an embodiment is particularly useful for quickly changing into, and out of, the apparatus during the course of a game or practice. Finally, in its most preferred form, belt member 18 is actually comprised of two individual belts that wrap around the waist of the player. Two smaller belts are preferred over a single larger belt as such an arrangement maintains a more secure fit as the player's body moves during use.

Figure 2:
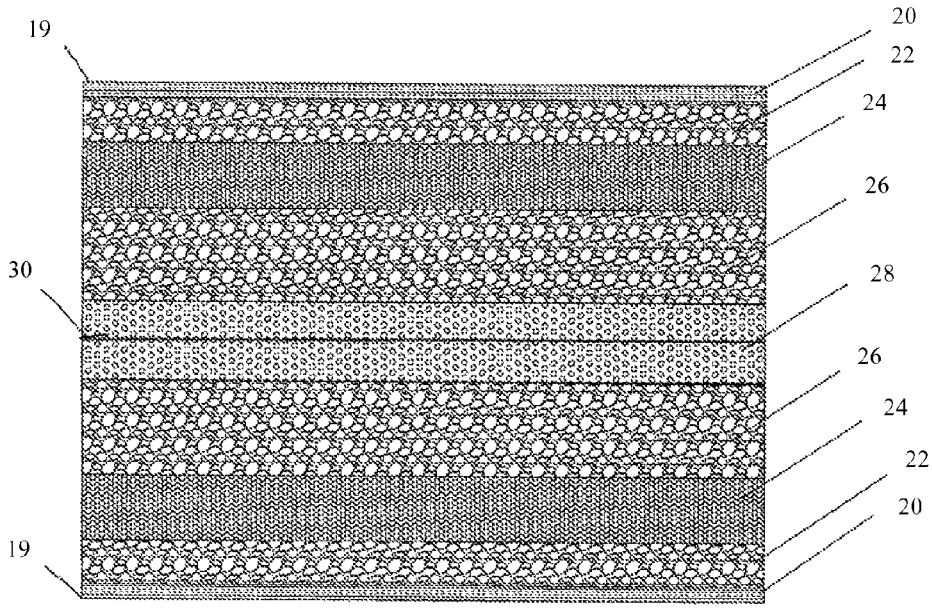
FIG. 2 is a cross section view of the apparatus of the first preferred embodiment of the present invention.

Referring to FIG. 2, padded member 12 is characterized by a multi-layer configuration, where each layer performs a specific function. Each layer, alone and in combination with other layers, imparts several novel attributes to Applicant's invention. Layer 19, the outermost layer is comprised of a thin, breathable nylon composite. This layer provides protection of the other components of the apparatus while maintaining a comfortable feel for the user in that it is breathable and does not induce agitation for its user during use. Finally, layer 19 may be produce in a variety of colors and designs in order to better fit the desired application or activity of its user.

Next, layer 20 is juxtaposed with the inside of layer 19 and the outside of layer 20. Layer 20 is comprised of a thicker, more durable layer of material such as nylon or some composite thereof. This layer is highly water resistant and provides strength for holding apparatus 10 together and flexibility in allowing apparatus 10 to contour to the shape of its user.

Layer 22 is juxtaposed with the inside of layer 20 and the outside layer 24. Layer 22 in the preferred embodiment is a quilted fabric layer of material. Layer 22 is relatively thin, yet of course, does provide some degree of protection by simply acting as an additional layer of padding. Importantly, layer 22 provides for efficient manufacturing of device 10. That is, layer 22 aids as a filler so that an assembly needle, sewing the constituent components together, can more easily penetrate through layer 20. Also, layer 22 serves to reduce relative movement between layer 20 and layer 24. That is, the outer surface of layer 22 is comprised of some course material that essentially "grabs" the layer 20 and layer 24. Without this layer, apparatus 10 would be of diminishing usefulness over time as the protective materials contained within become distorted under the outside material. In fact, a common problem associated with known products is "bunching" of protective material as the player moves during the course of use. However, as discussed, Applicant's invention eliminates any such problem.

Layer 24 is juxtaposed with the inside of layer 22 and the outside of layer 26. In its most preferred form, this layer is comprised of a foam material and is preferably between one eighth and one quarter inch in thickness. This foam layer provides for shock absorption and distribution, and, provides structural integrity and added thickness to the apparatus overall.

Layer 26 is juxtaposed with the inside of layer 24 and the outside of layer 28 (the inner most layer). Layer 26 is a thick batting layer; however, it is similar to layer 22 in so much as it is comprised of a course, and relatively porous, material that "grabs" surrounding layers to help hold each intact with respect to the other. Layer 26 is particularly effective in protecting layer 28, which contains air-filled bladders 30, from abrasive forces that may cause damage. Finally, while layer 26 may be relatively thick (preferably being between one quarter to one half inch thickness), its low density nature contributes to relatively light weight of apparatus 10.

Layer 28 is the innermost layer of apparatus 10. Preferably, layer 28 is a dual layered system of some plastic component having a series of air-filled bladders 30. This layer serves as the core of the apparatus and is excellent in responding to forces exerted thereon. More specifically, air-filled bladders 30 efficiently react to forces imparted by objects contacting padded member 12 and respond to bending or folding of padded member 12 caused by the player's movement during use. Finally, layer 28 may have air bladders 30 of different dimensions to better accommodate the expected strength of incident forces (i.e., adults may need greater protection in most instances) and may comprise one or more layers to further provide protection.

DETAILED DESCRIPTION OF ALTERNATE PREFERRED EMBODIMENT

Figure 3A:
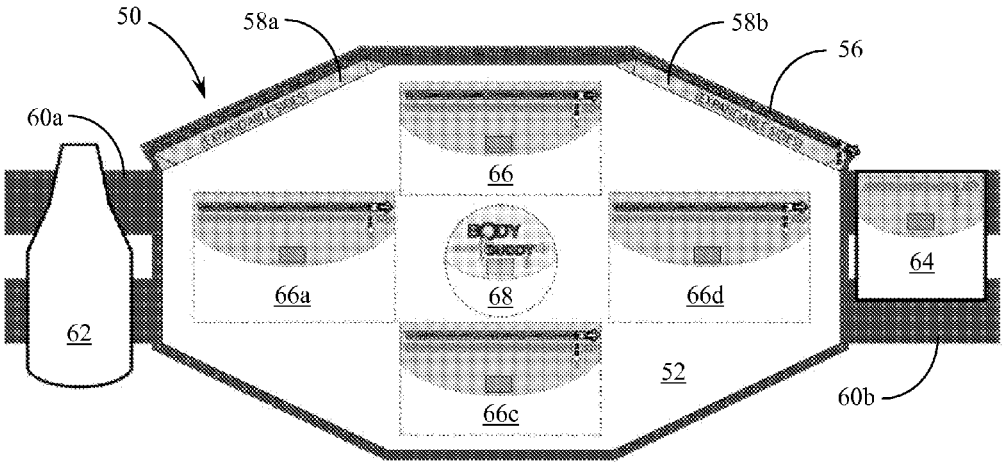
FIG. 3A is a side plan view of the outward face of the first panel of the second preferred embodiment of the present invention.
Figure 3B:
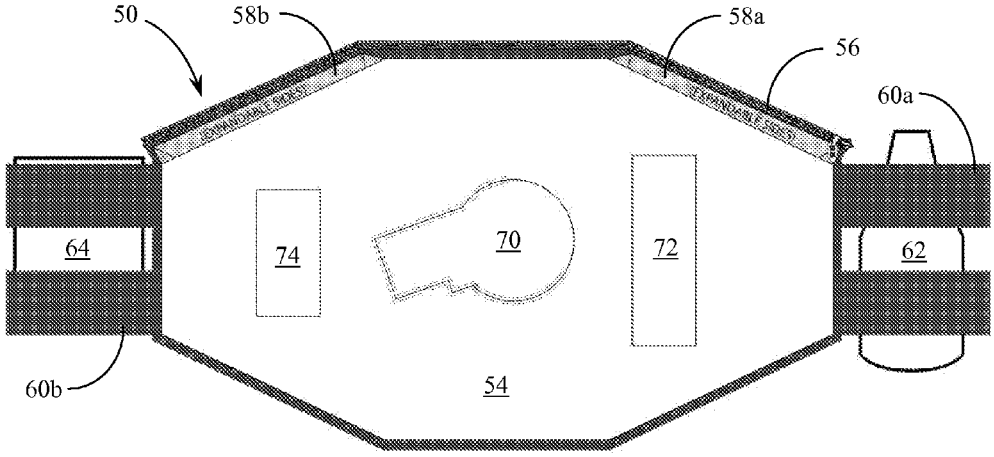
FIG. 3B is a side plan view of the inward face of the first panel of the second preferred embodiment of the present invention.

Referring to FIG. 3A, the first panel of the main member 40 of the present invention is generally designated by the reference numeral 50. First panel 50 is primarily characterized by an outward face 52 and an inward face 54, as shown in FIG. 3B. The main member 40 is generally of an elongate shape, having a broader center section while being tapered about each distal end. Such a configuration is particularly beneficial in that it allows its user a free range of motion while providing ample space for storage of items. As discussed previously, this configuration allows the user to bend, twist, or rotate at the waist without restriction. The main member may be of different dimensions, sized according to the user. As such, the general arrangement of component layers of the main member remains the same, while its actual dimensions may vary.

The first panel 50 is further characterized by belt strap sections 60*a* and 60*b*, which serve to secure the main member about its user. Belt strap sections 60*a* and 60*b* extend from the distal ends of the main member to wrap around the waist of the user. Belt strap sections 60*a* and 60*b* may be securely fastened by any number of securing means as known in the art, such as plastic clips or elastic. The belt strap sections 60*a* and 60*b* may be comprised of two individual belts that wrap around the waist of the user to provide a more secure fit during use. As shown in FIG. 3A, a bottle pocket (pouch) 62 is located on belt strap section 60*a*. A belt pocket 64 with Velcro® flap and zippered compartment across the top is located on belt strap section 60*b*.

As described above, the belt pack is characterized by a multi-layer configuration, where each layer performs specific functions. Each panel, alone and in combination with the other panels, imparts several novel attributes to Applicant's invention. The first panel 50, the outermost panel, contains four multi-compartment pockets with flaps (66*a*, 66*b*, 66*c*, and 66*d*) which are arranged around a center pocket 68 with a Velcro®-fastening flap. Each of the multi-compartment pockets has a flap which is held in place with a Velcro® tab and a zipper compartment located at the top of the flap. The upper aspect of the first panel 50 has expandable sides 58*a* and 58*b*. These expandable sides are fastened to the second panel (see 80 in FIG. 4A) by a zipper 56.

The inward face of the first panel 54 is shown in FIG. 3B. A holster pocket 70 (sized to hold a handgun) is located in the center of the first panel 54. A pocket 72 for a flashlight is located on one side of the holster pocket 70 and a rectangular pocket 74 for miscellaneous use is located on the other side of the holster pocket 70.

Figure 4A:
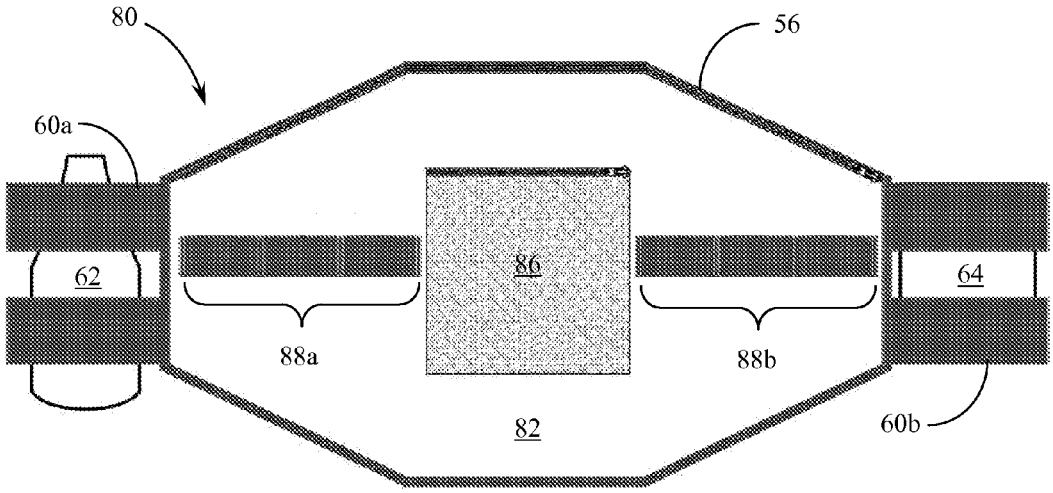
FIG. 4A is a side plan view of the outward face of the second panel of the second preferred embodiment of the present invention.
Figure 4B:
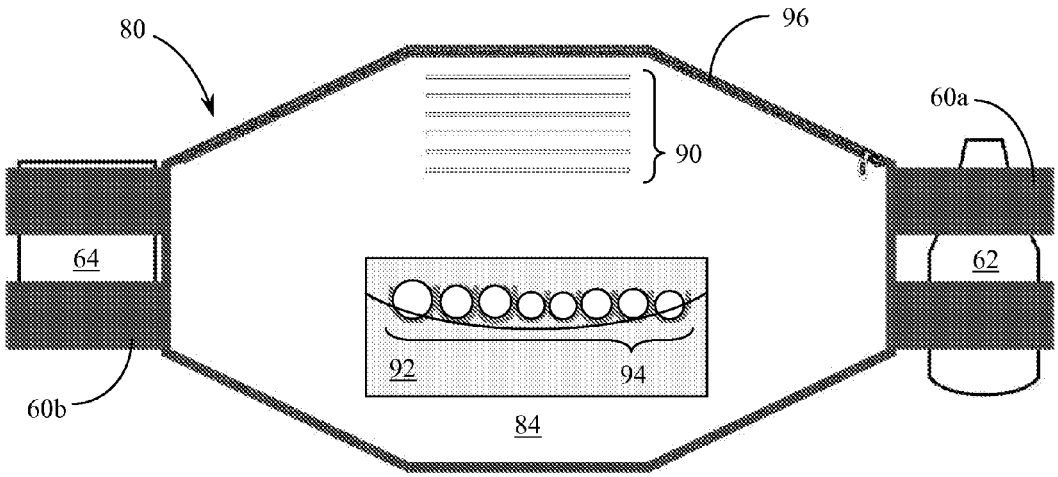
FIG. 4B is a side plan view of the inward face of the second panel of the second preferred embodiment of the present invention.

The second panel 80 is shown in FIGS. 4A and 4B. The outward face of the second panel 82 is shown in FIG. 4A. This face of the second panel contains a large zippered mesh pocket 86 located near the middle of the panel. On either side of the pocket 86 there are three elastic bands 88*a* and 88*b* configured to hold miscellaneous items such as a comb or pen. The inward face of the second panel 84 is shown in FIG. 4B. The upper aspect of the inward face of the second panel 84 has a zipper 96. This zipper 96 attaches the inward face of the second panel 84 to the outward face of the third panel 102. Located on the lower half of this face of the second panel 84 is a large rectangular coin pocket 92 having coin holders 94 of graduated sizes to hold coins of varying denominations. Located on the upper half of the inward face of the second panel 84 is a plurality of currency pockets 90 arranged to hold paper currency.

Figure 5A:
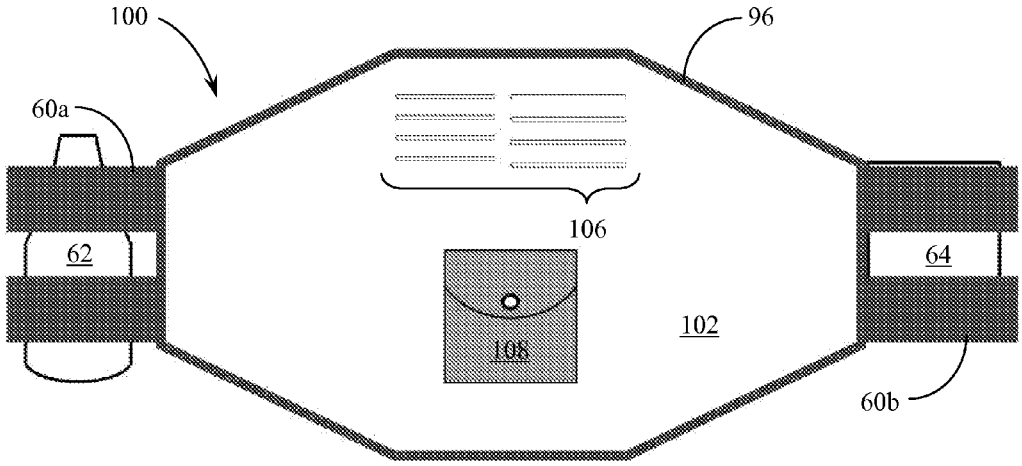
FIG. 5A is a side plan view of the outward face of the third panel of the second preferred embodiment of the present invention.
Figure 5B:
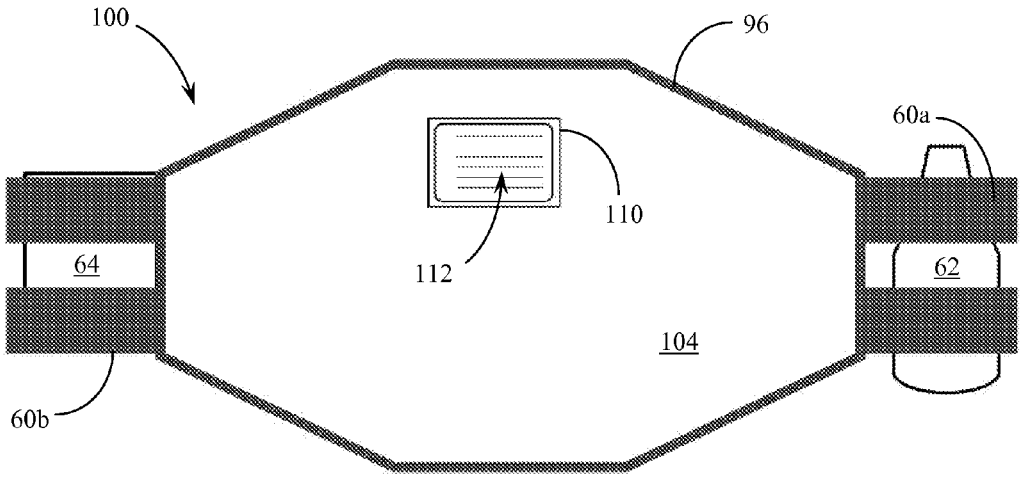
FIG. 5B is a side plan view of the inward face of the third panel of the second preferred embodiment of the present invention.

The third panel 100 is shown in FIGS. 5A and 5B. The outward face of the third panel 102 is shown in FIG. 5A. Located on the lower half of this face of the third panel is a camera pocket 108 having a flap attachment which is secured by a snap or other means of attachment. Located on the upper half of the outward face of the third panel is a plurality of card pockets 106 designed to hold standard wallet-sized cards, such as identification cards, driver's license, and credit cards. The inward face 104 of the third panel 100 is shown in FIG. 5B. The surface of this face is smooth except for a card holder 110 designed to hold an identification card 112. The smooth surface of this face 104 of the third panel 100 is designed to fit comfortably against the user.

Figure 6:
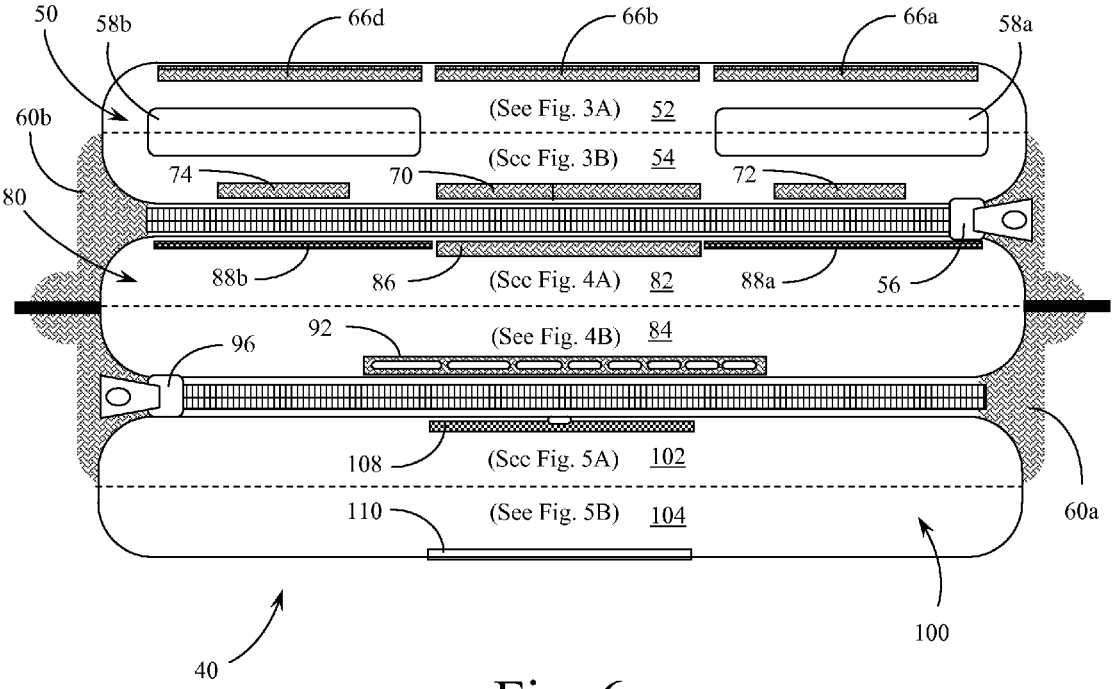
FIG. 6 is a top plan schematic view of the multiple layers of the present invention.

FIG. 6 shows a top plan schematic diagram of the multi-layered belt pack and its three panels 50, 80, and 100. As shown in FIG. 6, the first panel 50 is farthest from the body of the user. The second panel 80 is sandwiched between the inward face of the first panel 54 and the outward face of the third panel 102. The inward face of the third panel 104 lies against the torso of the user.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A multi-layered, multi-purpose padded belt pack to be worn about the waist, the belt pack comprising:

(a) a main member having a length and a width, the length extending generally along the waist of the wearer, the length being generally greater than the width, the main member comprising:

(i) first, second, and third panels positioned in a layered arrangement, the first, second, and third panels each comprising a perimeter edge, a first face, and a second face, the first panel at least partially secured to the second panel along the perimeter edges of the first and second panels, the second panel at least partially secured to the third panel along the perimeter edges of the second and third panels, the first and second panels forming a first enclosure between the first and second panels, and the second and third panels forming a second enclosure between the second and third panels;

(ii) at least one closure means positioned along at least a portion of the perimeter edges of the first and second panels so as to alternately open and close the first enclosure between the first and second panels, and at least one closure means positioned along at least a portion of the perimeter edges of the second and third panels so as to alternately open and close the second enclosure between the second and third panels; and (iii) a plurality of individually configured pockets positioned on at least one face of at least one of the first, second, and third panels; and (b) a belt member secured to and extending between a first and a second location on a perimeter edge of the main member, the belt member being configured to adjustably fit about the waist of the wearer.

2. The padded belt pack of claim 1, wherein the belt member comprises elastic material.

3. The padded belt pack of claim 1, wherein the belt member comprises two belt sections that wrap around the waist of the wearer.

4. The padded belt pack of claim 1, wherein the belt member further comprises a bottle pocket and a belt pocket.

5. The padded belt pack of claim 4, wherein the belt pocket further comprises a zipper closure and a hook and loop material tab closure.

6. The padded belt pack of claim 1, wherein the first, second, and third panels each further comprise multiple layers.

7. The padded belt pack of claim 6, wherein the multiple layers further comprise:

a breathable nylon layer;
a water resistant layer;
a quilted fabric layer;
a foam layer;
a lightweight batting layer;
a layer of air-filled bladders;
a lightweight batting layer;
a foam layer;
a quilted fabric layer;
a water resistant layer; and
a breathable nylon layer.

8. The padded belt pack of claim 1, wherein the first face of the first panel comprises four multi-compartment pockets each with a flap closure, and a center pocket with a flap closure.

9. The padded belt pack of claim 8, wherein each flap closure further comprises a hook and loop tab closure and a zippered pouch.

10. The padded belt pack of claim 1, wherein the first panel further comprises at least partially expandable sides at least partially secured to the adjoining second panel by a zipper closure.

11. The padded belt pack of claim 1, wherein the second face of the first panel further comprises a holster shaped pocket, a flashlight shaped pocket, and a generally rectangular pocket.

12. The padded belt pack of claim 1, wherein the first face of the second panel further comprises a zippered mesh pocket and a plurality of elastic bands.

13. The padded belt pack of claim 1, wherein the second panel further comprises at least partially expandable sides at least partially secured to the adjoining third panel by a zipper closure.

14. The padded belt pack of claim 1, wherein the second face of the second panel further comprises at least one coin pocket with coin holders and at least one currency pocket.

15. The padded belt pack of claim 1, wherein the first face of the third panel further comprises a camera pocket with flap closure.

16. The padded belt pack of claim 1, wherein the first face of the third panel further comprises a plurality of card pockets.

17. The padded belt pack of claim 1, wherein the second face of the third panel further comprises an identification card holder with a transparent cover.

18. A multi-layered, multi-purpose padded belt pack to be worn about the waist, the belt pack comprising:

(a) a main member having a length and a width, the length extending generally along the waist of the wearer, the length being generally greater than the width, the main member comprising:

(i) first, second, and third panels positioned in a layered arrangement, the first, second, and third panels each comprising a perimeter edge, a first face, and a second face, the first panel at least partially secured to the second panel along the perimeter edges of the first and second panels, the second panel at least partially secured to the third panel along the perimeter edges of the second and third panels, the first and second panels forming a first enclosure between the first and second panels, and the second and third panels forming a second enclosure between the second and third panels;

the first face of the first panel comprising four multi-compartment pockets each with a flap closure and a center pocket with a flap closure;

the second face of the first panel comprising a holster shaped pocket, a flashlight shaped pocket, and a generally rectangular pocket;

the first face of the second panel comprising a zippered mesh pocket and a plurality of elastic bands;

the second face of the second panel comprising at least one coin pocket with coin holders and at least one currency pocket;

the first face of the third panel comprising a camera pocket with flap closure and a plurality of card pockets; and the second face of the third panel comprising an identification card holder with a transparent cover;

(ii) at least one closure means positioned along at least a portion of the perimeter edges of the first and second panels so as to alternately open and close the first enclosure between the first and second panels, and at least one closure means positioned along at least a portion of the perimeter edges of the second and third panels so as to alternately open and close the second enclosure between the second and third panels; and (iii) a plurality of individually configured pockets positioned on at least one face of at least one of the first, second, and third panels; and (b) a belt member secured to and extending between a first and a second location on a perimeter edge of the main member, the belt member being configured to adjustably fit about the waist of the wearer.

* * * * *